US006142812A

United States Patent [19]

Hwang

[11] Patent Number: 6,142,812

[45] Date of Patent: Nov. 7, 2000

[54] CONNECTOR

[75] Inventor: Gyu Sang Hwang, Kwacheon, Rep. of Korea

[73] Assignee: KMW Co., Ltd., Kyoungki-Do, Rep. of Korea

[21] Appl. No.: 09/185,616

[22] Filed: Nov. 4, 1998

[30] Foreign Application Priority Data

Jun. 2, 1998 [KR] Rep. of Korea ..... 98-9387

[51] Int. Cl.[7] ..... H01R 13/627

[52] U.S. Cl. ..... 439/352; 439/848

[58] Field of Search ..... 439/555, 846, 439/352, 345, 346, 848, 282

[56] References Cited

U.S. PATENT DOCUMENTS

| | | | |
|---|---|---|---|
| 3,206,540 | 9/1965 | Cohen | 174/89 |
| 3,471,824 | 10/1969 | Greulich et al. | 439/282 |
| 3,745,514 | 7/1973 | Brishka | 439/848 |
| 4,017,139 | 4/1977 | Nelson | 439/352 |
| 4,789,351 | 12/1988 | Fisher, Jr. et al. | 439/248 |
| 5,176,533 | 1/1993 | Sakurai et al. | 439/352 |
| 5,637,010 | 6/1997 | Jost et al. | 439/352 |

*Primary Examiner*—Brian Sircus
*Assistant Examiner*—Son V. Nguyen
*Attorney, Agent, or Firm*—Oliff & Berridge, PLC

[57] ABSTRACT

The present invention relates to a connector capable of fastening a plug and a jack easily and stengthening the fastening force between the plug and the jack, comprise a first connecting means having a first connecting body, a first connecting pin installed in a inside of said first connecting body, and an insert ring fitted on one side end of said first connecting body; a second connecting means having a second connecting body fitted in said insert ring of said first connecting body, and a second connecting pin connected with said first connecting pin; a tightening means for fixing said second connecting means to said first connecting means, and said tightening means being installed inside said first connecting means; and a means for releasing said fastening force, and said means for releasing being installed in an end portion of said first connecting body.

15 Claims, 8 Drawing Sheets

CONNECTOR

BACKGROUND OF THE INVENTION

1. Field of the Invention

The present invention relates to a connector for connecting cables to transmit a radio frequency. More particulary, it relates to a connector capable of fastening a plug and a jack easily and strenthening the fastening force between the plug and the jack.

2. Description of Related Art

Generally, a connector comprises a plug and a jack which are fastened with each other in order to connect cables for transmitting a radio frequency. The connector is classified into a coupling nut type and a snap-on type according to a method for fastening the plug and the jack.

Hereinafter, referring to the FIGS. 1*a,* 1*b* and 2, a connector according to the prior art will be schematically described.

As shown in FIG. 1*a,* the connector of the coupling nut type according to the prior art comprises a plug and a jack connected with each other.

The plug has a plug body 51, a first connecting pin 52, and a nut 54. One side periphery of the plug body 51 is formed in a serration and a ferrule 57 is fitted with the serrated periphery. The first connecting pin 52 is installed inside the plug body 51 via a first insulator 53. The nut 54 is installed on the other side periphery of the plug body 51 via a C-ring 55 and a gasket 56.

The jack has a jack body 61, a second connecting pin 62, and a nut 65. The periphery of the jack body 61 is formed in a screw thread 61*a* for fastening the nut 54. The second connecting pin 61 is installed inside the jack body 61 via a second insulator 63.

On connecting the plug and the jack, the connecting pins 52 and 62 are connected with each other by fastening the scerew thread 61*a* with the nut 54, then the nut 65 is fastened securely.

On the other hand, as shown in FIG. 1*b,* the connector of the snap-on type according to the prior art comprises a plug and a jack. In this case, the plug has a plug body 51, and the plug body 51 has a protrusion 51*a* on an end portion thereof. Further, the jack has a jack body 61, and the jack body 61 has a recess 61*b* on an inner surface thereof. The protrusion 51*a* is fitted in the recess 61*b* elastically.

Therefore, the plug and the jack can be fastened with each other by fitting the protrusion 51*a* of the plug body 51 in the recess 61*b* of the jack body 61.

As the above stated, since the plug body 51 and the jack body 61 of the coupling nut type connector are fastened with each other by the nut 54 and the screw thread 61*a,* the connector has a strong fastening force, but the connector requires much time and space to fasten and separate the plug body 51 and the jack body 61.

Also, since the plug and the jack of the snap-on type are fastened by fitting the protrusion 51*a* of the plug body 51 in the recess 61*b* of the jack body 61, the connector can fasten rapidly and accomplish the fastening work in a small space, but there is a problem that the connector has a weak fastening force.

Furthermore, in order to connect a cable with the connector of the snap-on type, as shown in FIG. 2, after a user fits the cable with the first connecting pin 52 of the plug body 51 directly, the user can clamp the cable and plug body 51 using the ferrule 57, or solder a core of the cable with the first connecting pin. At this time, there is a problem that the connecting work is complicated because the user should insert the cable into the connector and fix the cable and the connector.

SUMMARY OF THE INVENTION

It is, therefore, an object of the present invention to provide a connector capable of accomplishing promptly a fastening work of the plug and jack in the small space, and maximizing the fastening force between the plug and the jack.

In order to accomplish the above object, a connector according to the present invention comprises: a first connecting means having a first connecting body, a first connecting pin installed inside of said first connecting body, and an insert ring fitted on one side end of said first connecting body; a second connecting means having a second connecting body fitted in said insert ring of said first connecting body, and a second connecting pin connected with said first connecting pin; a tightening means for fixing said second connecting means to said first connecting means, and said tightening means being installed inside said first connecting means; and a means for releasing said fastening force, and said means for releasing being installed in an end portion of said first connecting body.

In order to accomplish the above objective, the present invention further provides a connector comprising; a connecting means having a connecting body, a connecting pin installed inside of said connecting body, and an insert ring fitted on one side end of said connecting body; a cable having a predetermined length core portion to be connected with said connecting pin; a tightening means for fixing said connecting means to said connecting means, and said tightening means being installed inside said connecting means; and a means for releasing said fastening force, and said means for releasing being installed in an end portion of said connecting body.

BRIEF DESCRIPTION OF THE ATTACHED DRAWINGS

Other features in structure, operation and advantages of the present invention will become more apparent to those skilled in the art from the following descriptions when read in conjunction with the accompanying drawings, in which:

FIG. 1*a* is a cross-sectional view showing a connector of a coupling nut type according to the prior art, with a part of portion cut off partially.

FIG. 1*b* is a cross-sectional view showing a connector of a snap-on type according to the prior art, with a part of portion cut off partially.

Figure 7A:
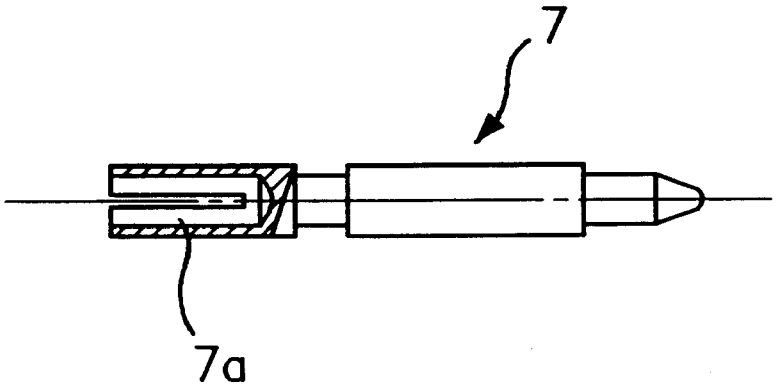
Figure 7B:
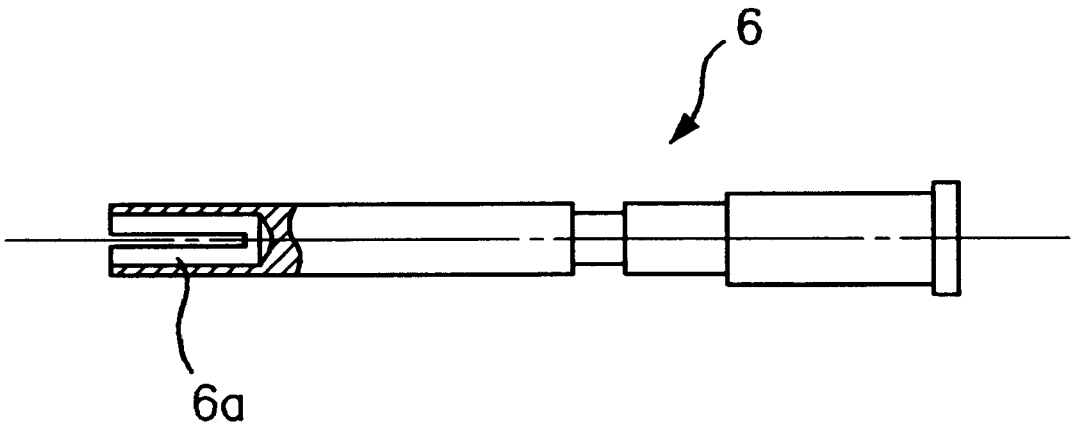

FIGS. 7*a* and 7*b* shows a connecting pin of the connector according to the present invention.

Figure 8:
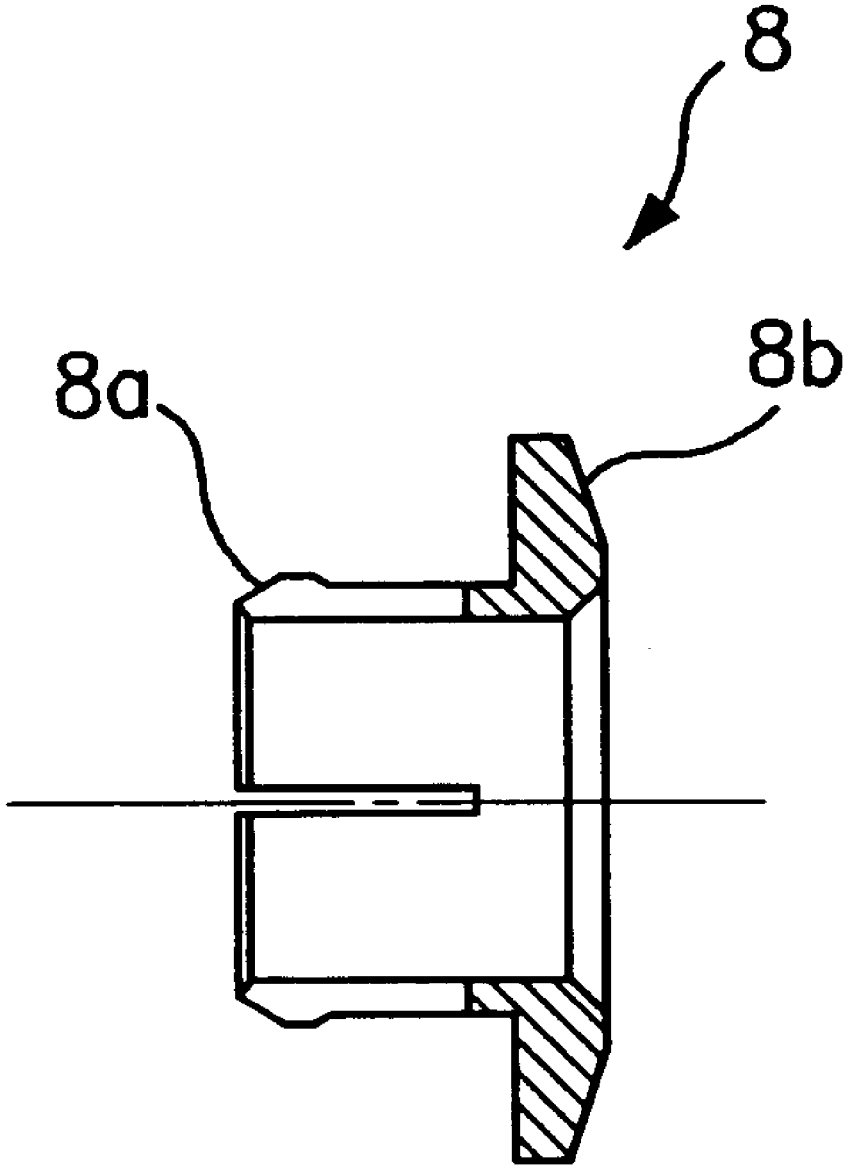

FIG. 8 shows a releasing ring of the connector according to the present invention.

Figure 9:
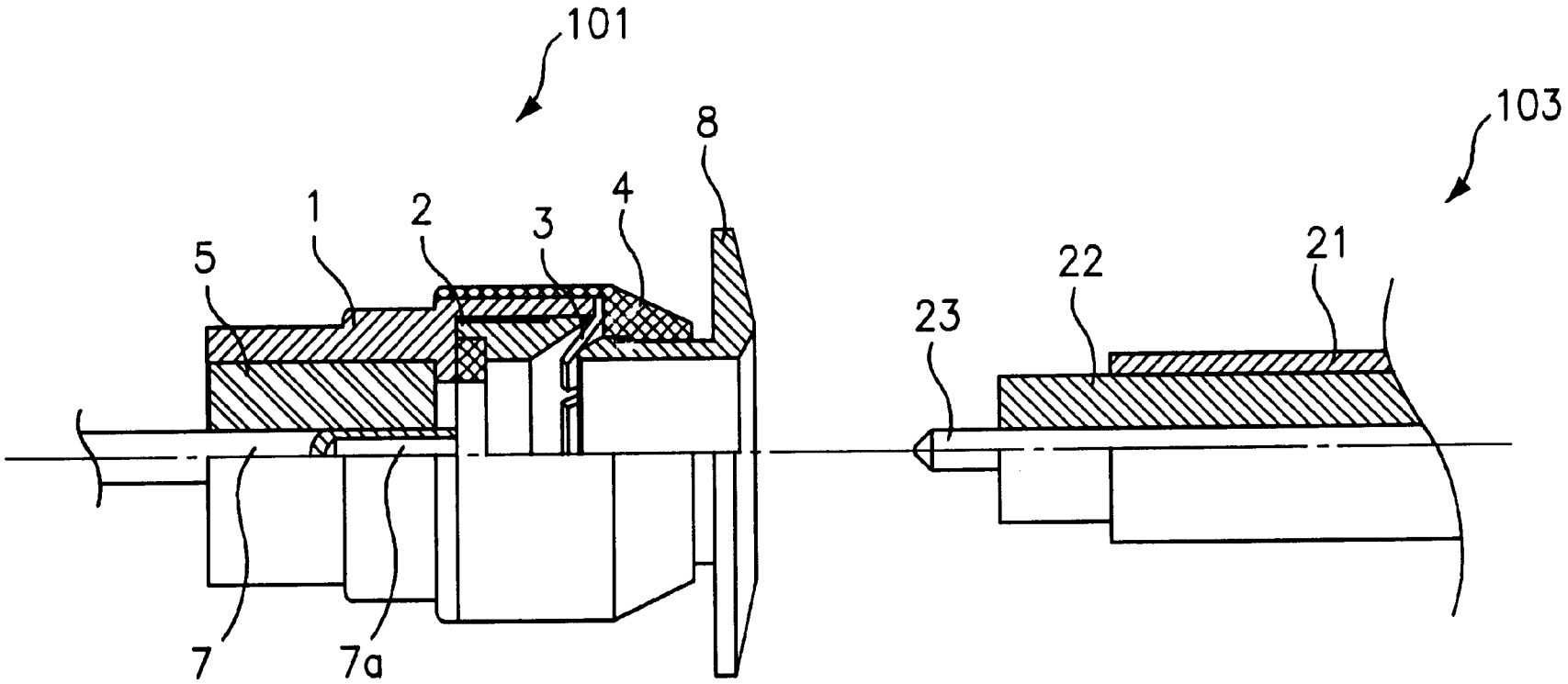

FIG. 9 shows a connector according to a second embodiment of the present invention.

DETAILED DESCRIPTIONS OF A PREFERRED EMBODIMENT

Hereinafter, the embodiments according to the present invention will be described in detail, referring to the drawings.

Figure 1A:
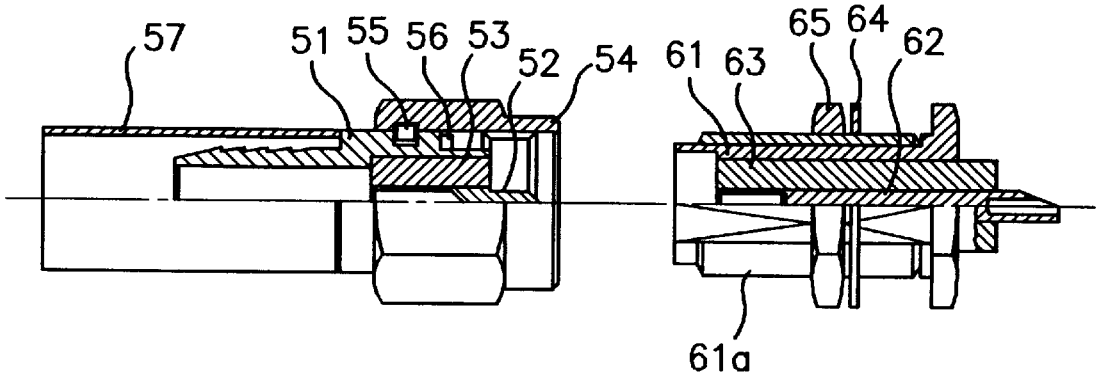
FIG. 1A (PRIOR ART)
Figure 1B:
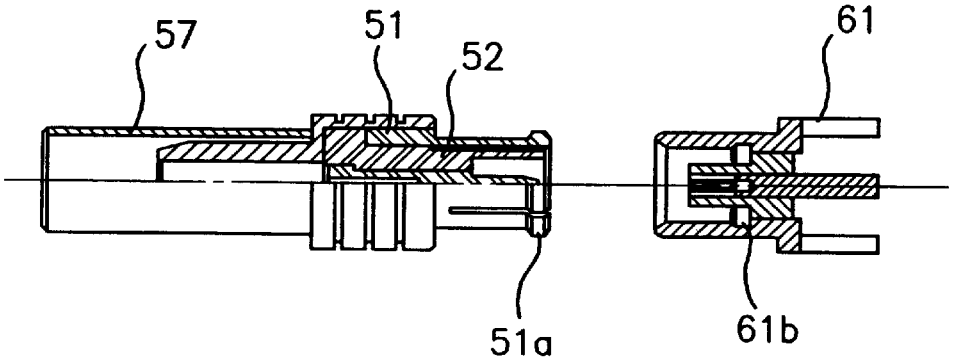
FIG. 1B (PRIOR ART)
Figure 2:
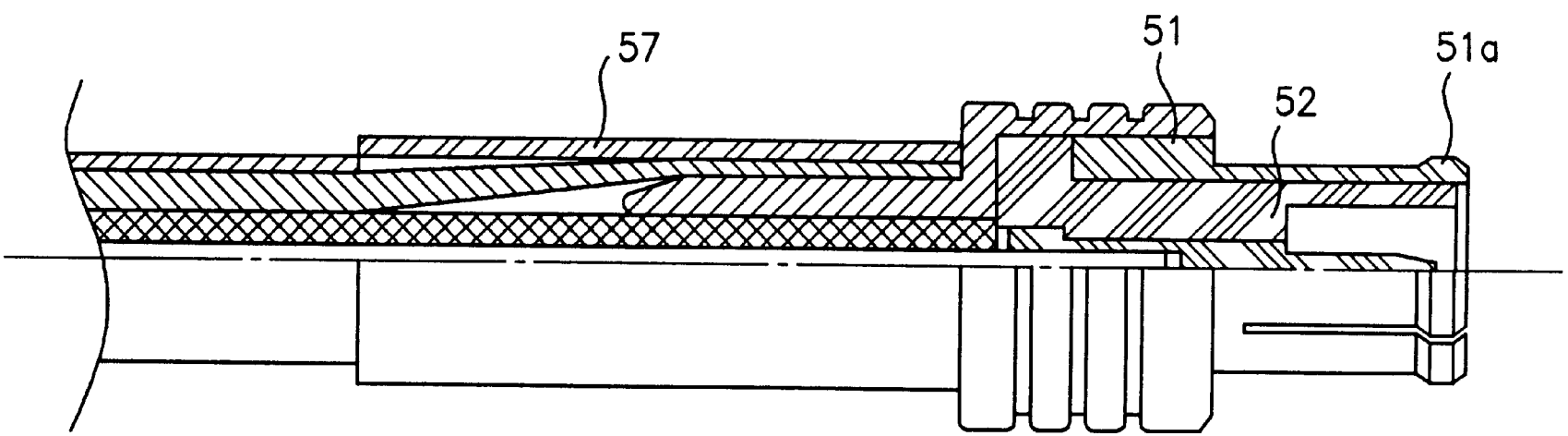
FIG. 2 (PRIOR ART)
FIG. 2 is cross-sectional view showing a connection state between the connector according to the prior art and a cable, with a part of portion cut off partially.
Figure 3:
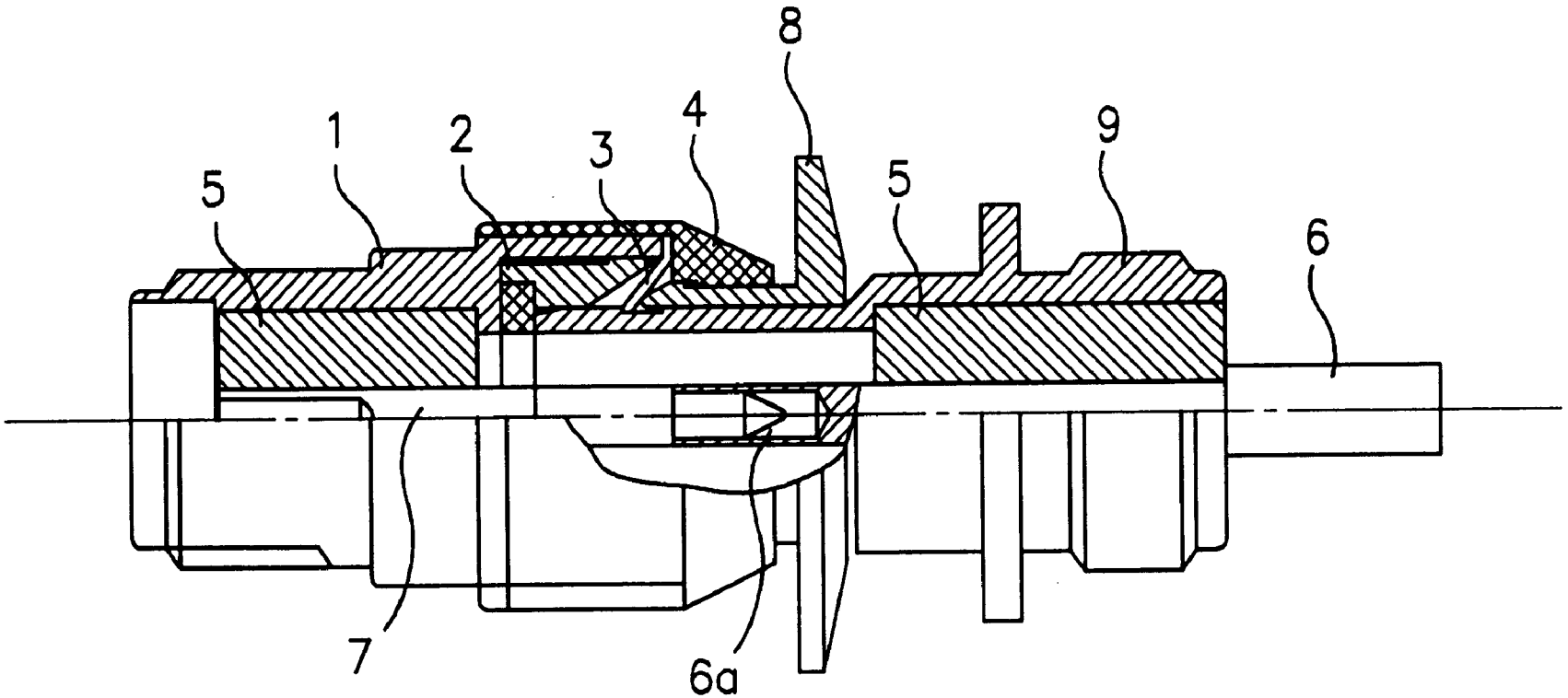
FIG. 3 is a cross-sectional view showing an assembly of a plug and a jack of a connector according to a first embodiment of a present invention, with a part of portion cut off partially.
Figure 4:
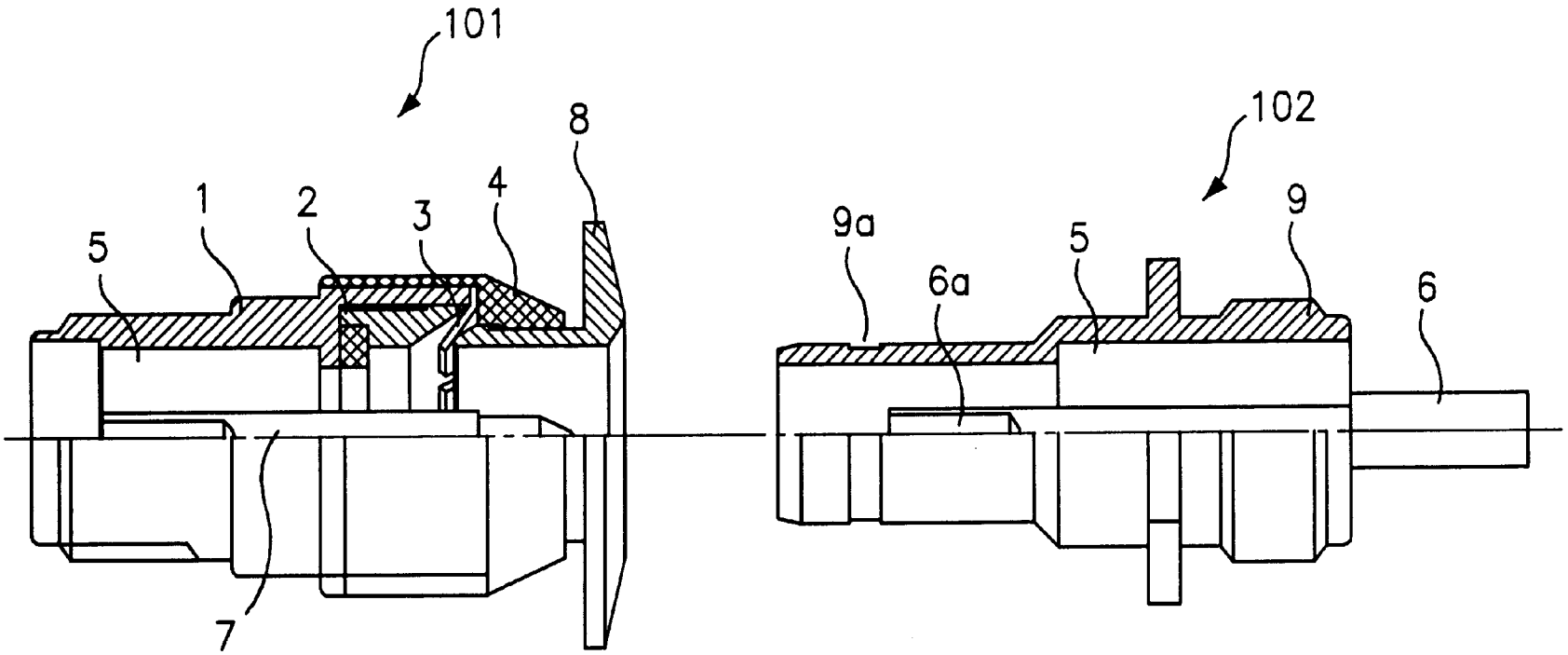
FIG. 4 is a cross-sectional view showing a plug and a jack of the connector according to the embodiment of the present invention, with a part of portion cut off partially.

As shown in FIGS. 3 and 4, a connector according to a first embodiment of present invention capable of accomplishing promptly a fastening work in a small space, and maximizing a fastening force comprises a plug 101 having a fastening means, a jack 102 fitted in the plug 101, and a means for releasing the fastening force.

As shown in FIG. 4, the plug 101 has a plug body 1 having a first through hole therein, an insert ring 2 fitted in outer surface of the plug body 1, a tightening ring 3, and a clamping cap 4 fitted on the peripheral portion of the plug body 1. The insert ring 2 supports the jack 102. The means for releasing a fastening force is fitted in the clamping cap 4 and the clamping cap 4 fixes the means for releasing a fastening force.

In this case, the tightening ring 3 is formed in a tapered ring spring with a plurality of cutting portions 3*a* formed in spaced-apart. Further, a fixing plate 3*b* is unitedly formed on a center peripheral portion having the largest diameter of the tightening ring 3. When the tightening ring 3 is abutted on the insert ring 2, the fixing plate 3*b* is sandwiched between the clamping cap 4 and a side surface of the plug body 1 so that the tightening ring 3 is fixed. Therefore, a side cross-sectional view of the tightening ring 3 is substantially a W shape (see FIG. 5). Further, the tightening ring 3 can be expanded or contracted in the radial direction of the plug body 1 by the cutting portions 3*a* (see FIG. 6).

Furthermore, the plug 101 has a plug pin 7 installed in the center portion of the first through hole, and the plug pin 7 has a groove 7*a* for fitting a cable in a side end portion thereof. The plug body 1 and the plug pin 7 are connected with each other via an insulator 5 (see FIG. 7*a*). In this case, the plug pin 7 is connected with a core of a cable.

The jack 102 has a jack body 9, and the jack body 9 has longitudinally a second through hole therein. Further, the jack 102 has a jack pin 6 installed in the center portion of the second through hole, and the jack pin 6 has a fitting groove 6*a* for fitting the plug pin 7 in a side portion thereof (see FIG. 7*b*). In this case, the jack pin 6 is connected with a core of a cable. The jack pin 6 and jack body 9 is connected with each other via an insulator 5. Furthermore, the jack body 9 has a recess 9*a* gripped by the tightening ring 3.

Therefore, when the jack body 9 is inserted into the plug body 1, the jack body 9 is moved from the large diameter portion toward the small diameter portion of the tightening ring 3. At this time, the tightening ring 3 is expanded in the radial direction by the the cutting portions 3*a* so that the inserting work of the jack body 9 can be accomplished easily and rapidly. On the other hand, when the jack body 9 has been fastened with the plug body 1, since the tightening ring 3 tightens the jack body 9 by its elasticity, the jack body 9 can be connected with the plug body 1 securely.

Furthermore, the means for releasing a fastening force is composed of a releasing ring 8 fitted in the clamping cap 4, and the releasing ring 8 has longitudinally a third through hole therein. The releasing ring 8 has an inclination portion 8*a* on one side peripherial portion thereof so that the releasing ring 8 can be easily inserted into the inside of the tightening ring 3. Further, the releasing ring 8 has a disk portion 8*b* on the other side peripheral portion thereof. In this case, the diameter of the third through hole is larger than the diameter of the jack body 9 so that the jack body 9 is fitted therein.

Figure 5:
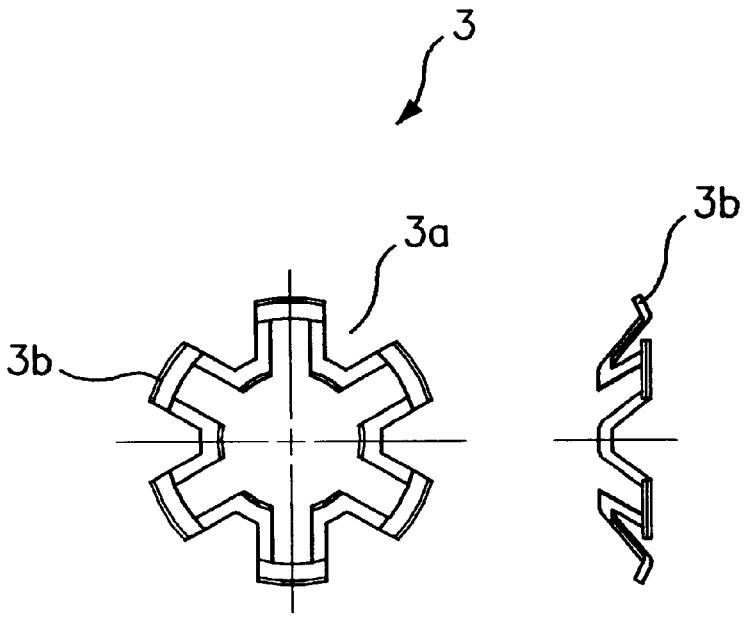
FIG. 5 shows a tightening ring of the connector according to the present invention.
Figure 6:
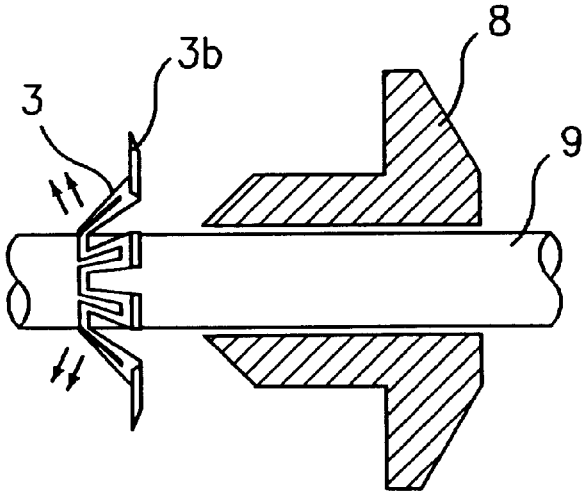
FIG. 6 is a cross-sectional view showing a operating state of the tightening ring of the connector according to the present invention.

When the jack body 9 is inserted in the side of the plug body 1, the jack body 9 goes through the hole of the releasing ring 8 and is fitted to the tightening ring 3. In this case, as shown in FIG. 5, the jack body 9 is fitted to an inside of the tightening ring 3 which is expanded by the cutting portion 3*a*. Further, when the jack body 9 moves in the inserting direction continuously, the tightening ring 3 grips the recess 9*a* formed on the jack body 9, then the tightening ring 3 tightens the peripheral surface of the jack body 9 by its elasticity. Thus, although the jack body 9 is pulled in the opposite direction of the inserting direction, it cannot be sepatated from the plug body 1. The plug pin 7 installed in the plug body 1 is fitted in the fitting grooves 6*a* of the jack pin 6 so that the connector according to the present invention can transmit radio frequency.

On the other hand, when a user would like to separate the jack body 9 from the plug body 1, the user can separate the jack body 9 from the plug body 1 by pushing the releasing ring 8 in the inserting direction. That is, when the user pushes the releasing ring 8 in the inserting direction, the tightening ring 3 gripping the recess 9*a* is expanded outwardly in the radial direction of the plug body 1 so that the jack body 9 can be separated from the plug body 1.

In the above-mentioned the first embodiment, it is described that the plug and the jack are fastened with each other, but the connector according to the present invention, as shown in FIG. 9, may be directly connected with a cable with in the plug 101.

In this case, the connecting pin 7 is installed in the center portion of plug body 1 so that its fixing groove 7*a* is faced to a cable 103. A sheath 21 and an insulator 22 of the cable 103 are stripped so that the core 23 of the cable 103 can be fitted with the fitting groove 7*a* of the connecting pin 7. At this time, when the cable 103 is connected with the plug body 1, the cable 103 is inserted into the insert ring 2 of the plug body 1 so that the cable 103 is engaged to the tightening ring 3.

On the other hand, the user can separate the cable 103 from the body 1 by pushing the releasing ring 8 in the inserting direction. At this time, in this embodiment, since the cable 103 is not snapped, the user can reuse the cable 103.

A connector according to the present invention comprised and operated as above mentioned can maximize a fastening force between a plug body and a jack body, and accomplish the fastening work easily and rapidly.

It should be understood that the present invention is not limited to the particular embodiment disclosed herein as the best mode contemplated for carrying out the present invention and is not limited to the specific embodiments described in this specification except as defined in the appended claims.

What is claimed is:

1. A connector comprising:

a first connecting means having a first connecting body, a first connecting pin installed inside of said first connecting body and an insert ring fitted on one side end of said first connecting body;

a second connecting means having a second connecting body fitted in said insert ring of said first connecting body, and a second connecting pin connected with said first connecting pin;

a retaining means having a through hole for passing the second connecting body to be fixed to the first connecting body and a plurality of cutting portions at a peripheral portion thereof, and said retaining means being installed inside said first connecting means; and a releasing means for pressing said retaining means to release said retaining means from said second connecting body by expanding the through hole of said retaining means, and said releasing means being movably installed in an end portion of said first connecting body.

2. A connector according to claim 1, further comprises a clamping cap for gripping said releasing means for releasing.

3. A connetor according to claim 2, wherein said retaining means consists of a tapered ring spring having a plurality of cutting portions in spaced-apart.

4. A connector according to claim 3, wherein said retaining means has a fixing plate protruded from an outer peripheral portion thereof, and when said fixing plate is sandwiched between said first connecting body and said clamping cap.

5. A connector according to claim 1, wherein said first connecting means includes a first insulator for insulating said first connecting pin from said first connecting body, a through hole being formed longitudinally therein; and said second connecting means includes a second insulator for insulating said second connecting pin from said second connecting body, a through hole being formed longitudinally therein.

6. A connector according to claim 1, wherein said second connecting body has a recess in an outer surface thereof, and when said second connecting means is connected with said first connecting means, said recess is tightened by said retaining means.

7. A connector according to claim 1, wherein said releasing means for releasing said retaining means comprises a releasing ring inserted into said retaining means.

8. A connector according to claim 7, wherein said releasing means for releasing has a inclination portion on one end portion thereof.

9. A connector comprising:

a connecting means having a connecting body, a connecting pin installed inside of said connecting body, and an insert ring fitted on one side end of said connecting body;

a retaining means having a through hole for passing a cable to be fixed to the connecting body and a plurality of cutting portions at a peripheral portion thereof, and the retaining means being installed inside said connecting means; and a releasing means for pressing said retaining means to release said retaining means from said cable by expanding the through hole of said retaining means, and releasing means being movably installed in an end portion of said connecting body.

10. A connector according to claim 9, further comprises a clamping cap for gripping said means for releasing.

11. A connector according to claim 10, wherein said retaining means consists of a tapered ring spring having a plurality of cutting portions in spaced-apart.

12. A connector according to claim 11, wherein said retaining means has a fixing plate protruded from an outer peripheral portion thereof, and when said fixing plate is sandwiched between said connecting body and said clamping cap.

13. A connector according to claim 9, wherein said connecting means includes an insulator for insulating said connecting pin from said connecting body, a through hole formed longitudinally therein.

14. A connector according to claim 9, wherein said releasing means for releasing said retaining means consists of a releasing ring inserted in said retaining means.

15. A connector according to claim 14, wherein said releasing means for releasing has a inclination portion on one end portion thereof.

* * * * *